United States Patent [19]

Calvino

[11] 4,205,208

[45] May 27, 1980

[54] DOUBLE-FLOW COMPRESSED-GAS OPERATING MECHANISM FOR A HIGH-VOLTAGE CIRCUIT-BREAKER

[75] Inventor: Ben J. Calvino, Monroeville, Pa.

[73] Assignee: Westinghouse Electric Corp., Pittsburgh, Pa.

[21] Appl. No.: 887,283

[22] Filed: Mar. 16, 1978

[51] Int. Cl.[2] ..... H01H 35/38

[52] U.S. Cl. ..... 200/82 R; 91/415; 200/148 A

[58] Field of Search ..... 200/148 R, 148 A, 148 B, 200/148 C, 148 D, 148 E, 148 F, 148 G, 148 H, 148 J, 148 BV, 82 R, 145, 61.86; 92/107, 108; 91/415

[56] References Cited

U.S. PATENT DOCUMENTS

| | | | |
|---|---|---|---|
| 2,997,564 | 8/1961 | Baker | 200/148 A |
| 3,189,700 | 6/1965 | Eidson | 200/82 R X |
| 3,485,046 | 12/1969 | Gebhardt | 92/108 |
| 3,858,485 | 1/1975 | Rosaen et al. | 91/415 |

*Primary Examiner*—J. V. Truhe
*Assistant Examiner*—Morris Ginsburg
*Attorney, Agent, or Firm*—L. P. Johns

[57] ABSTRACT

An improved double-flow-type of compressed-gas operating mechanism is provided for actuating a high-voltage circuit-breaker including a double driving head, movable, actuating piston, having different opposite working areas to thereby accommodate the higher power required to effect the opening operation (which may be as much as ten times the power needed for the closing operation) and the provision of suitable means for resiliently retaining the driving piston in either of its open or closed-circuit end positions.

3 Claims, 7 Drawing Figures

DOUBLE-FLOW COMPRESSED-GAS OPERATING MECHANISM FOR A HIGH-VOLTAGE CIRCUIT-BREAKER

CROSS-REFERENCE TO RELATED APPLICATIONS

Reference may be made to United States patent application filed March 1, 1978, Ser. No. 882,543, by the present applicant, relating to a three or four-break high-voltage circuit-breaker, utilizing the application set forth herein. Additionally, reference may be made to a companion United States patent application filed March 13, 1978, Ser. No. 885,846, by the same inventor, illustrating a further type of three-break, high-voltage circuit-interrupter, both of said patent applications being assigned to the assignee of the instant patent application.

BRIEF SUMMARY OF THE INVENTION

An improved, gas-operated, driving operating mechanism is provided for very quickly effecting a close-open operation of a high-voltage circuit-interrupter, wherein the time lag may be preferably only eight milliseconds. However, in an open-close operation, the time lag may be of the order of three hundred milliseconds. The present application is concerned with a double-acting, unitary piston-driving structure, having a double-head and adaptable for providing very high-power requirements for effecting quickly the opening operation of a high-voltage circuit-breaker. As well known by those skilled in the art, the power requirements for an opening operation of the circuit-breaker may be, for example, ten times the power requirements which are needed for closing the same circuit-breaker. Accordingly, the double-acting, double-head, driving piston of the instant invention has different piston-working, surface areas for accomplishing the aforesaid needed requirements.

Additionally, means, such as an overcenter toggle arrangement, for example, is utilized to resiliently retain the driving piston in either of its open or closed-circuit end positions. Also, improved exhausting ports are provided at suitable locations to quickly exhaust the operating gaseous fluid at the end of both the opening and closing strokes of the double-acting driving piston of the instant invention.

DESCRIPTION OF THE PREFERRED EMBODIMENT

Figure 2:
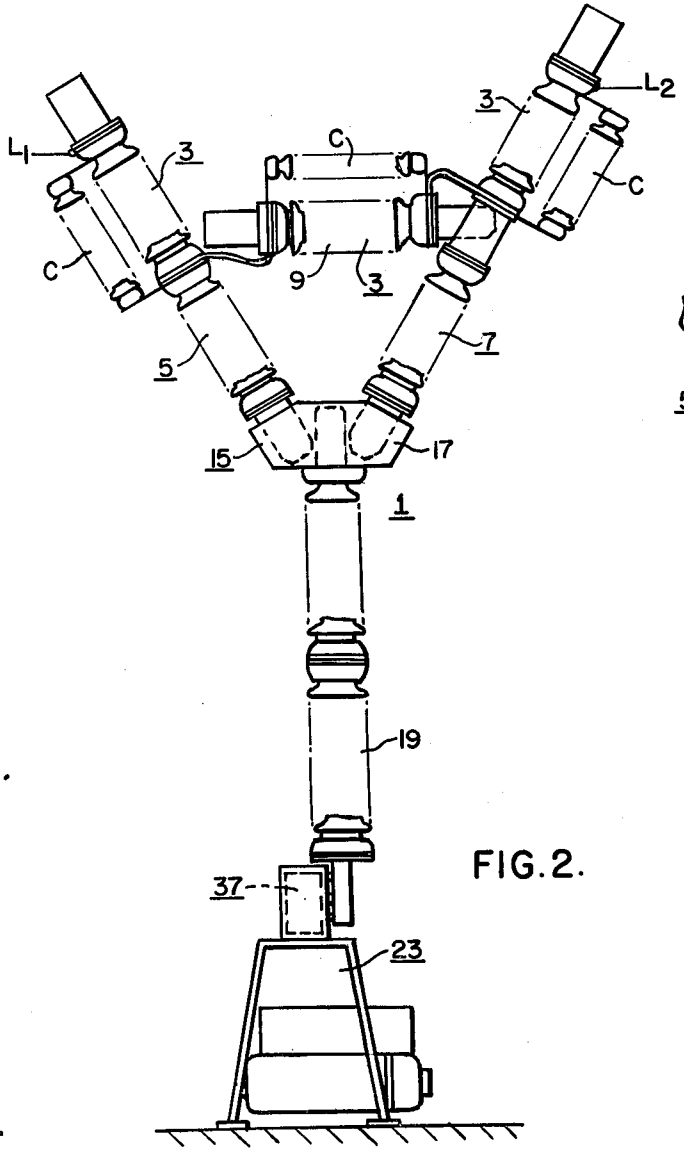
FIG. 2 is a side elevational view of the three-break, high-voltage, compressed-gas circuit-breaker of FIG. 1.
Figure 1:
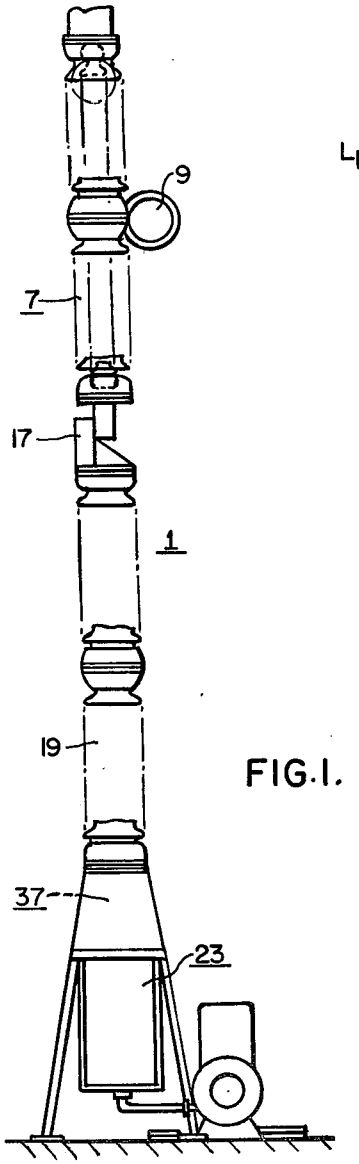
FIG. 1 is a front elevational view of a high-voltage, compressed-gas circuit-interrupter, particularly one of the three-break puffer-type, utilizing the improved operating mechanism of the instant invention.

Referring to the drawings, and more particularly to FIGS. 1 and 2 thereof, the reference numeral 1 generally designates a high-voltage, compressed-gas circuit-interrupter, having a voltage rating say, for example, of 420 kv. The three-break structure, as more clearly illustrated in FIG. 2, comprises three puffer-units 3, each of which is of the general type ilustrated somewhat diagrammatically in FIG. 6 of the drawings.

United States patent application filed Mar. 13, 1978, Ser. No. 885,846, By Ben J. Calvino, and assigned to the Westinghouse Electric Corporation, illustrates in detail, and with an extensive description, the operation of the three puffer-units 3, which are disposed adjacent the outer ends of the two slanted column branches 5, 7, and also a third puffer unit 3 disposed in somewhat bridging relationship within an insulating casing 9, as illustrated more clearly in FIG. 2 of the drawings.

Accordingly, there are provided three puffer breaks 3 in series, the puffer-units 3 all being actuated simultaneously by angularly-directed insulating operating rods 11 and 13, which are mechanically connected together by a double-arm crank-arm structure 15 disposed within a mechanism housing 17 surmounting the upstanding lower-disposed column structure 19.

Figures 6, 7:
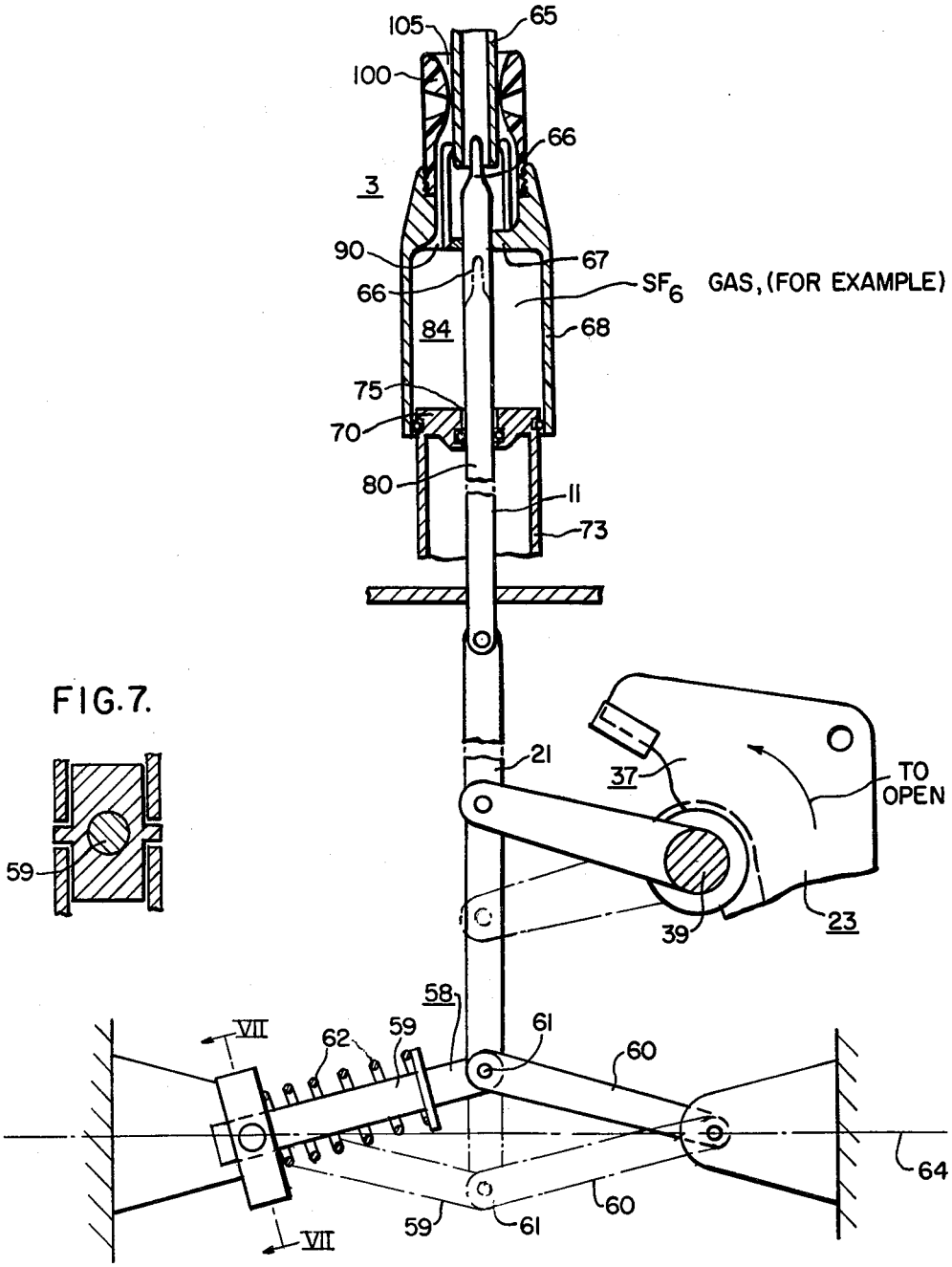
FIG. 6 is a fragmentary view of the linkage parts between the drive shaft and the puffer-unit, again the parts being indicated in the closed-circuit position; and, FIG. 7 is a fragmentary, sectional view taken along the line VII—VII of FIG. 6.

The puffer unit 3, is illustrated more clearly in FIG. 6, of the drawings, and as is well known by those skilled in the art, comprises a stationary contact 65 cooperable with a movable contact 66, the latter being affixed, as by a perforated spider connection 67, to a movable operating puffer cylinder 68 which is slidable over a stationary piston structure 70. The piston structure 70, as shown in FIG. 6 is stationarily, fixedly supported into a rigid position by an upstanding cylindrical support member 73. Slidable through the stationary piston structure 70, as by a guide aperture 75, is a movable contact-operating rod 80, which is mechanically linked to the lower-disposed insulating operating rod 11 of FIG. 3.

As will be apparent from an inspection of FIG. 6, there is provided a compression chamber 84 situated between the stationary piston structure 70 and the movable operating cylinder 68, which during the opening operation, is compressed by the downward opening movement of the operating cylinder 68, to thereby compress gas within this space 84, and to force a flow of upwardly-issuing gas through the apertures 90 of the perforated spider member 67, and through the hollow interior of a movable insulating nozzle member 100. Arc extinction occurs axially within the nozzle opening 105 by the compressed gas passing upwardly therethrough. Reference may be made to either of the aforesaid two patent applications for a detail description of the manner of arc interruption, together with a figure therein, illustrating the open-circuit position of the contact parts 65, 66 and gas-flow directions as well.

Figure 3:
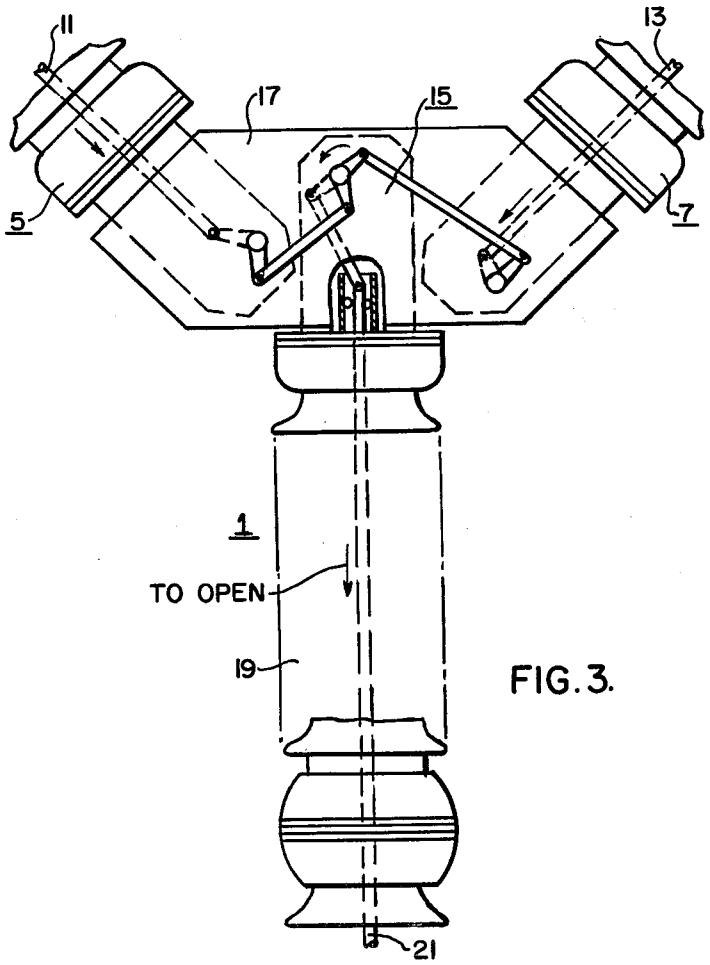
FIG. 3 is an enlarged, fragmentary, side-elevational view illustrating the interconnecting operating-rod linkage for operating the several puffer-units disposed interiorly within the upper slanted supporting arms, or branches of the generally-inverted "A"-type upstanding supporting structure, the operating-rod linkage parts being illustrated in the closed-contact position.

FIG. 3 illustrates more clearly the mechanical linkage 15 interconnecting the operating rods 11 and 13 with the lower-disposed, "first", main insulating operating rod 21 extending downwardly interiorly of the lower-disposed, upstanding, single column structure 19 of the FIGS. 1 and 2.

Figure 4:
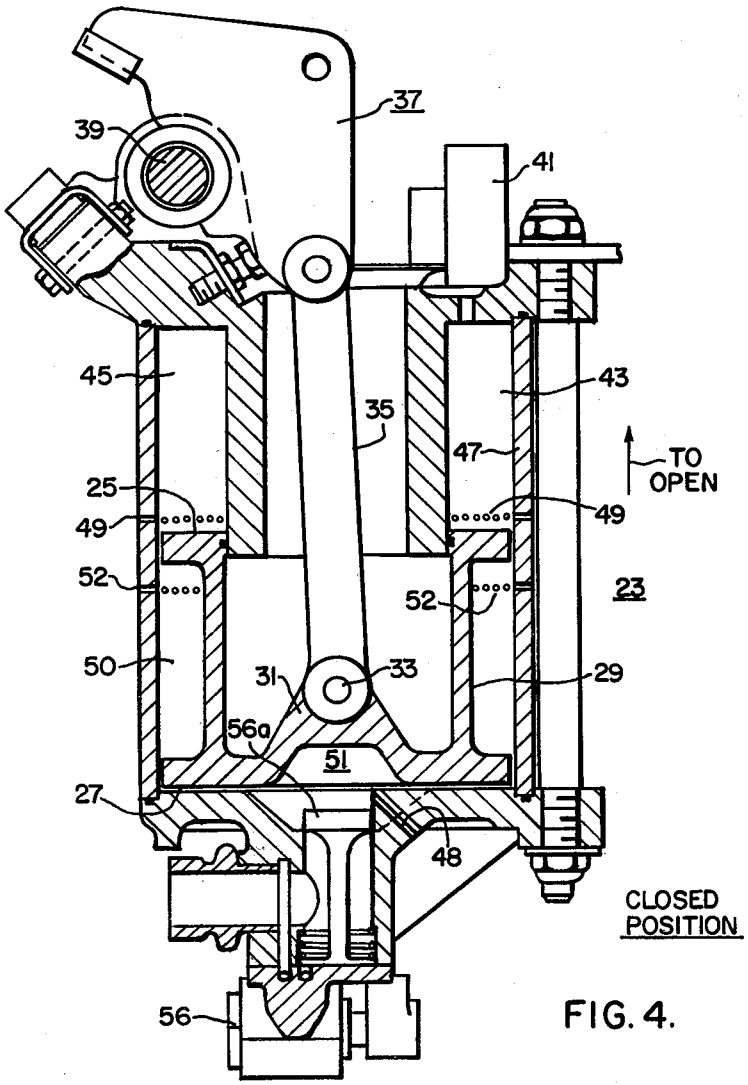
FIG. 4 is a vertical sectional view taken through the improved operating mechanism of the instant invention, the several component parts being illustrated in the closed-circuit position.

FIG. 4 illustrates more clearly the double-acting piston arrangement 23 of the instant invention, illustrating the different surface areas 25, 27 required for effecting a very fast opening operation, wherein the power requirements for opening the three-break circuit-breaker 1 may be, for example, around ten times more than the power requirements for effecting a closing operation of the circuit-breaker 1. With reference to FIG. 4, it will be observed that there is provided a double-acting, double-headed driving piston 29, having a center portion 31, which is pivotally connected, by a pivot pin 33, to a floating driving link 35 to a rotatable power-driving crank-arm structure 37, which effects opening and closing rotative movements of a main operating driveshaft 39.

Figure 5:
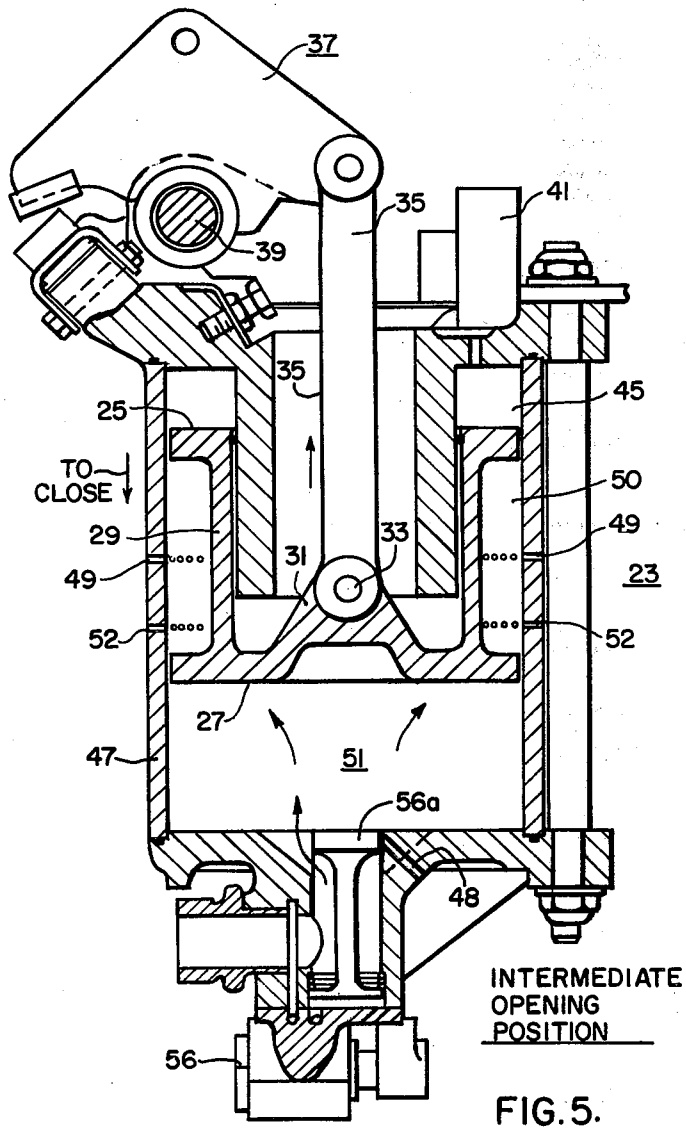
FIG. 5 is a view similar to FIG. 4, but illustrating the several parts in an intermediate breaker-opening operation.

FIG. 4 illustrates the circuit-breaker parts in the closed-circuit position; whereas FIG. 5 illustrates the circuit-breaker parts in an intermediate position during opening operation of the circuit-breaker 1.

An electrically-actuated closing valve 41 is provided to effect rapid admission of closing air or a suitable operating gas 43 through the valve 41 and into the upper end of the stationary operating cylinder 47 and into the annular closing space volume 45 disposed above the double-acting driving piston 29.

It will be noted that there are provided a plurality of exhaust holes or venting ports 49 to quickly vent the closing air 43 within volume 45 at the end of the downward closing stroke as viewed in FIG. 4. This enables the annular closing volume space 45 to be quickly exhausted and in readiness for a subsequent opening operation of the circuit-breaker 1.

The provision of a double-headed piston construction 29 will, as is obvious, lead to an intervening, interposed annular volume 50, which permits the lower opening surface area 27 to expose a plurality of exhausting holes, or venting ports 52, which exhaust the opening volume to the atmosphere, or other surrounding ambient around cylinder 47, and thereby permits the mechanism 23 to be in readiness for a subsequent closing operation. FIG. 5 more clearly illustrates the disposition of the several parts in an intermediate position during the opening operation, in which it will be observed that the exhaust holes 49 and 52 are outside opening volume 51. As is usual, an opening gas valve 56, preferably actuated by any suitable means, is provided for quickly effecting the admission of opening air or operating gas into the opening volume 51 of the piston structure 23.

An exhausting, or "dump" port 48 is provided at the lower end of the operating cylinder 47 to freely vent the opening volume 51 when the opening valve 56 is inoperable. It will be observed that the opening valve has a cylindrical valve portion 56*a* to block off this "dump" port 48 when the opening valve 56 is electrically actuated.

A similar "dump" or exhausting vent opening (not shown) may be associated with the closing valve 41.

To retain the piston structure 29 in either the open or closed-circuit positions, suitable means 58 are provided for retaining such structure 23 in either the open or closed-circuit positions, the particular means provided herein comprising an overcenter toggle arrangement, for example. With reference to FIGS. 6 and 7, it will be observed that the overcenter toggle 58 comprises two toggle-links 59, 60 pivotally connected together at 61, the lefthand toggle-link 59 having a compression spring 62 encircling such leg 59, and being compressed at the "on-center" position 64 of the toggle-linkage 58. Accordingly, it will be obvious that the compression spring 62 tends to retain the piston mechanism parts 58 in either the open or the closed-circuit position by an extension or expansion of such compression spring 62 in either of such open or closed-circuit positions.

From the foregoing description, it will be apparent that there is provided a novel, double-acting, power-driving piston 29 having an opening surface area 27 of considerably greater surface area than the closing surface area 25, since the power for opening the circuit-breaker 1 may be, for example, ten times the power requirements needed for closing the circuit-breaker 1. The provision of the different piston surfaces 25, 27 for closing and opening the circuit-breaker is thus of assistance. In the open-close operation, the time lag may be, for example, three hundred milliseconds. However, in the close-open operations, the time lag may be only eight milliseconds. Accordingly, the rapid exhausting of the closing and opening volumes 45, 51 is necessary to evacuate the respective opening and closing volumes 45, 51 and hence accommodate the structure for rapid reverse travel of the movable piston 29. The number of holes can be different to change the emptying spaces. In other words, for high-speed reclosing operations, it may be preferable to provide a greater number of closing-air exhaust holes 49 than the opening-air exhaust holes or venting ports 52.

The shape of the hollow movable piston allows a substantial reduction of the dimensions of the operating mechanism in length. As the circuit-breaker must have two resting positions, this type of operating mechanism 23 should preferably be used with the toggle-holding device 58, which will tend to maintain the operating piston 29 in its at-end resting positions.

Although there has been illustrated and described a specific operating mechanism, it is to be clearly understood that the same was merely for the purpose of illustration; and that changes and modifications may readily be made therein by those skilled in the art, without departing from the spirit and scope of the invention.

I claim:

1. In combination, a high-voltage, compressed gas circuit-interrupting structure having one or more separable contacts to effect the opening and closing of a connected circuit, operating means for moving the contacts between open and closed positions, means defining a stationary operating cylinder having an inwardly-directed tubular guide-portion extending therewithin and thus forming an annular chamber (45), the operating means comprising a movable double-flanged driving piston having one flange portion thereof slidable and guided by said inwardly directed tubular guide-portion and with the outer periphery of said flange portion guided by an inner cylinder wall, an opposite flange portion of said movable piston extending entirely across an entire inner cross-section of the stationary operating cylinder so as to present a greatly-increased surface working area, as contrasted with the relatively-small annular surface (25) of the first mentioned flange portion of the movable driving piston, means defining a rotatable operating shaft, means interconnecting said movable piston structure to said rotatable operating shaft by a pivotally-connected piston-rod extending through the center of said inwardly-directed tubular guide-portion and connected to a crank-arm lever affixed to said rotatable operating shaft, valve means (41) for admission of high-pressure gas to the annular volume (45) formed between the inner cylinder wall and the outer surface of said inwardly-directed tubular guide-portion, additional valve means for the admission of the high-pressure gas across the entire opposite working face of said piston throughout the entire inner diameter of the stationary operating cylinder, means defining a plurality of exhaust apertures communicating with said annular volume (45) so as to exhaust the gas within said annular volume (45) at the end of the movable piston at one end of its stroke, and means defining a plurality of other exhaust apertures provided in the wall of the stationary operating cylinder to thereby exhaust the high-pressure gas from the volume of the operating cylinder at the other end of the working stroke of said movable piston.

2. The combination according to claim 1, wherein there are means including an over-center spring-biased toggle linkage for resiliently retaining the movable piston at either of its end at-rest positions.

3. The combination according to claim 1, wherein said exhaust apertures provide a greater number of closing-air venting ports (49) than the number of opening-air venting ports (52).

* * * * *